US007003246B2

(12) United States Patent
Gogate et al.

(10) Patent No.: US 7,003,246 B2
(45) Date of Patent: Feb. 21, 2006

(54) FUSER NIP RELEASE MECHANISM

(75) Inventors: Hrishikesh Pramod Gogate, Lexington, KY (US); Harald Portig, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 20 days.

(21) Appl. No.: 10/809,653

(22) Filed: Mar. 25, 2004

(65) Prior Publication Data

US 2005/0214042 A1 Sep. 29, 2005

(51) Int. Cl.
*G03G 15/16* (2006.01)

(52) U.S. Cl. ..... 399/122

(58) Field of Classification Search ..... 399/176, 399/213, 214, 240, 272, 273, 278, 279, 281, 399/288, 303, 304, 313, 320, 328, 330, 331, 399/21, 33, 122, 124

See application file for complete search history.

(56) References Cited

U.S. PATENT DOCUMENTS

| | | | | |
|---|---|---|---|---|
| 4,110,068 | A * | 8/1978 | Brown et al. | 432/60 |
| 4,145,181 | A * | 3/1979 | Edwards et al. | 432/60 |
| 4,154,575 | A * | 5/1979 | Edwards et al. | 432/60 |
| 4,162,847 | A * | 7/1979 | Brandon | 399/67 |
| 4,498,757 | A * | 2/1985 | Lance et al. | 399/332 |
| 4,958,195 | A * | 9/1990 | Firth et al. | 399/332 |
| 6,035,160 | A * | 3/2000 | Kim | 399/122 |
| 6,253,046 | B1 * | 6/2001 | Horrall et al. | 399/124 |

* cited by examiner

*Primary Examiner*—Diego Gutierrez
*Assistant Examiner*—Dixomara Vargas
(74) *Attorney, Agent, or Firm*—John J. McArdle

(57) ABSTRACT

A nip release mechanism for a fuser of a printing device includes a movable component in the printer base frame moved by opening and closing a cover, and a follower component in the fuser which follows movement of the movable component to adjust positions of a fuser pressure roll.

20 Claims, 7 Drawing Sheets

FUSER NIP RELEASE MECHANISM

BACKGROUND OF THE INVENTION

1. Field of the Invention

The present invention relates generally to fusers and electrophotographic printing devices, and, more particularly, to release mechanisms that unload the nip formed by the pressure roll against the hot roll in the fuser.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser.

A fuser is known to include a heated roll and a pressure roll, each covered with a compliant outer covering. The pressure roll is loaded against the heated roll by means of a spring-loaded bell crank to create a nip region for fusing the toner.

As color printers have become smaller in size, to reduce cost and to minimize space requirements in offices, the paper path through the printer has become shorter and shorter. As a result, if a paper jam or other process interruption occurs while a portion of the media is still in the fuser nip, the media is likely trapped in at least one and as many as four transfer nips. In some vertical machine architectures, the PC drum to transfer roll nip is located in the front of the machine. As the door of the machine is opened, the media is caught in nips between rolls moving with the opening cover and the fuser nip. The fuser nip pressure is normally higher than even a combination of several transfer nips. The media is likely pulled out of the transfer nips rapidly as the door is opened, which could cause damage to the PC drums or even cause the PC drums to be pulled off the front door. The PC drum is unloaded when the door is fully opened, but for the first part of the door motion the PC drum is still loaded against the transfer rolls. The paper will tug on the PC drum and slip in the transfer nips, possibly scratching the drums or even pulling them from their located features in the front door.

Several attempts are known in the prior art to overcome this problem. Manual levers have been used on the fuser module to relieve the fuser nip load. This requires an additional action by the user, and is not desirable. Further, because the fuser load is high, significant mechanical advantage is required, which results in a large, unsightly fuser nip release lever. Since opening the cover does not automatically release the fuser nip, it is possible that a user could open the cover and attempt to remove a jam without releasing the fuser nip lever potentially causing damage to the machine.

It is known also to employ a mechanism whereby opening one cover causes a part in the base machine to push on the fuser bell crank, thus releasing the fuser nip. In designs of this type it is common that the front door cannot be opened unless the cover that releases the fuser nip is opened first. A disadvantage of this design is that the base machine applies considerable load to the fuser module, which makes inserting or removing the fuser module difficult for the user.

A further attempted solution has been to provide a mechanism on board the fuser module itself that opens and closes the fuser nip. The actuation of the mechanism is also accomplished internal to the fuser itself. Usually this is achieved through a gear train and cam acting on the spring loaded bell cranks, which could be powered by a separate motor or by reversing the fuser motor. A disadvantage of this design is that the mechanism is expensive and may require a separate motor in the case of printers in which the fuser motor is dedicated to driving the fuser rolls forward and backward in a duplexing arrangement.

What is needed in the art is a simple, inexpensive and effective structure to automatically unload the fuser nip and to retain the fuser nip in an unloaded position during servicing.

SUMMARY OF THE INVENTION

The present invention provides a nip release cam rotated by a link mechanism when the printer cover is opened. The nip release cam moves a nip release cam follower, which rotates the bell crank sufficiently to unload the fuser nip. A locking feature on the cam follower automatically locks onto the fuser frame to hold the pressure roll in an open nip position. Closing the cover reverses the actuation mechanism thereby loading the fuser nip.

In one aspect thereof, the present invention provides a printing apparatus with a machine frame and a cover assembly pivotally connected to the machine frame and moveable between closed and opened positions. A fuser assembly is mounted in the machine frame and includes a hot roll, a pressure roll for forming a fuser nip with the hot roll, and loading means applying force to the pressure roll against the hot roll. A nip release mechanism is operable to adjust the loading means between loading and unloading conditions. A linkage assembly interconnects the cover assembly and the nip release mechanism for operating the nip release mechanism by moving the cover assembly between opened and closed positions.

In another aspect thereof, the invention provides a fuser nip release mechanism for a printing apparatus having a cover assembly and a fuser module having a hot roll, a pressure roll nip against the hot roll and loading means for moving the pressure roll with respect to the hot roll. The fuser nip release mechanism has an actuating means to engage and disengage the loading means between loaded and non-loaded conditions; and a linkage assembly connecting the actuating means and the cover assembly for moving the actuating means in response to opening and closing the cover assembly.

In still another aspect thereof, the invention provides a nip release mechanism for a printing apparatus having a machine frame, a cover assembly rotatably connected to the machine frame and a removable fuser module including a hot roll, a pressure roll and loading means for holding the pressure roll against the hot roll. The nip release mechanism has a movable component in the machine frame connected to the cover to be moved by movement of the cover between opened and closed positions. A follower in the fuser module is engageable with the movable component, the follower being moved by movement of the movable component. A connection between the follower and the loading means moves the loading means in response to movement of the follower.

An advantage of the present invention is providing automatic unloading of the fuser nip as a machine cover is opened to facilitate service of the printing device, and automatic nip loading as the cover is closed.

Another advantage is providing a simplified structure for loading and unloading the fuser nip not requiring additional motors and gear trains.

A further advantage of the present invention is automatically securing the fuser nip in an opened position so long as the fuser is uninstalled, thereby reducing potential roll or roll cover distortion.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
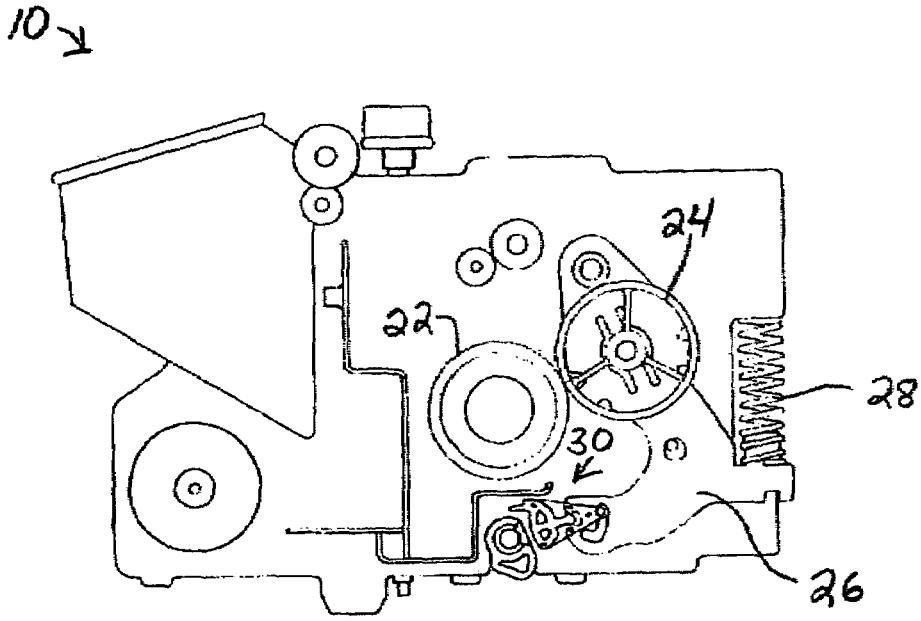
FIG. 1 is a schematic, fragmentary illustration of a printing device having a fuser nip release mechanism in accordance with the present invention, the fuser nip being shown in a loaded condition.
Figure 2:
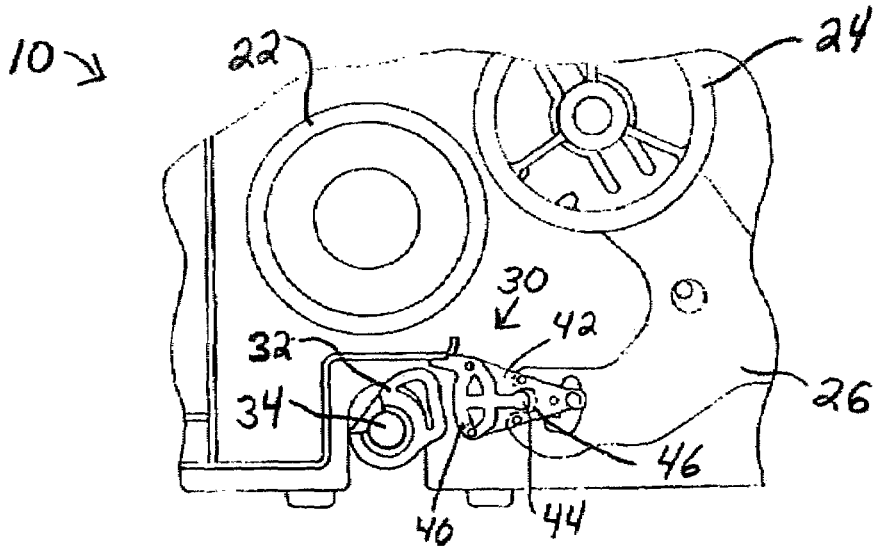
FIG. 2 is an enlarged schematic, fragmentary illustration of the fuser nip in the printing device of FIG. 1, but illustrating the fuser nip in an open, non-loaded condition.
Figure 3:
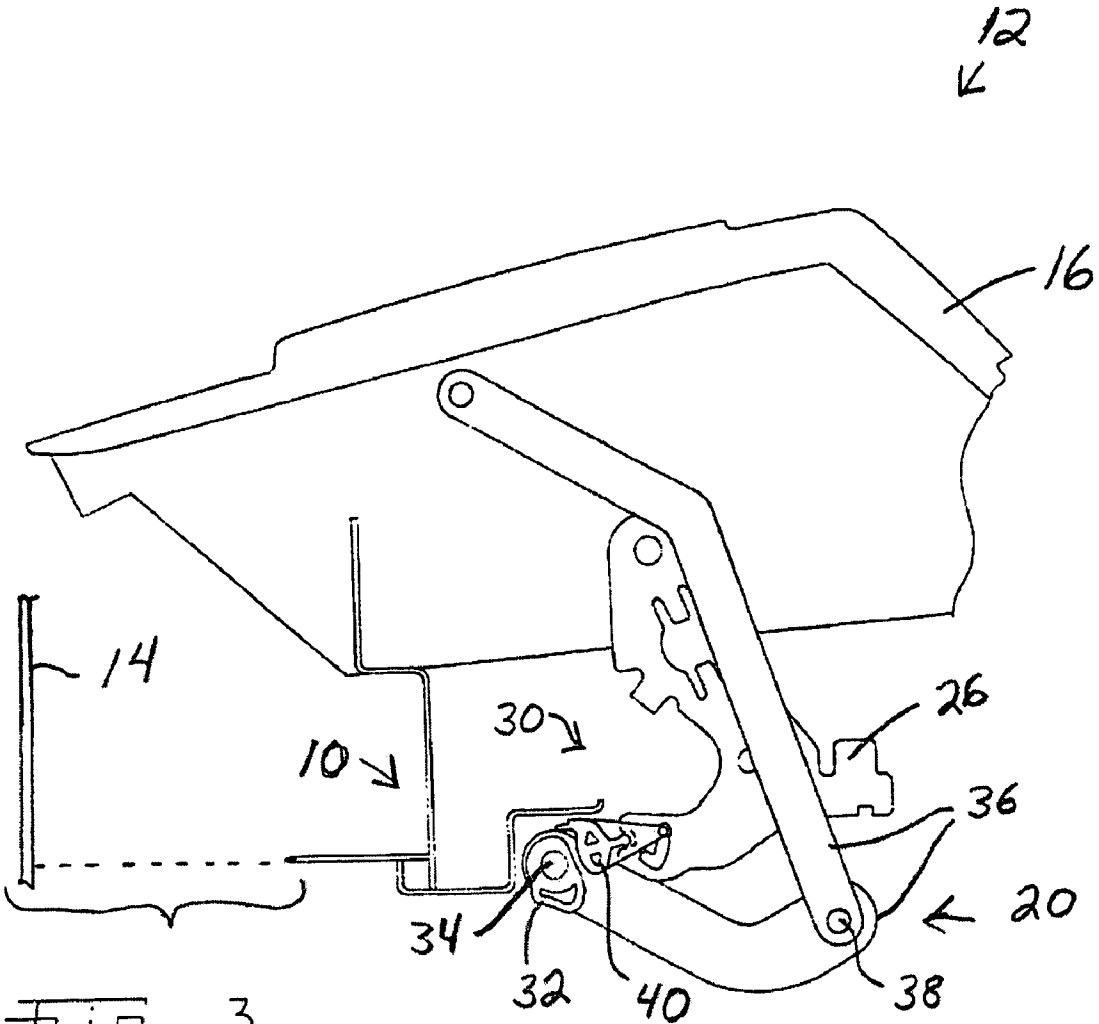
FIG. 3 is a fragmentary, schematic illustration of the printing device and the fuser nip release mechanism of the present invention, with the nip shown in a closed and loaded position.
Figure 4:
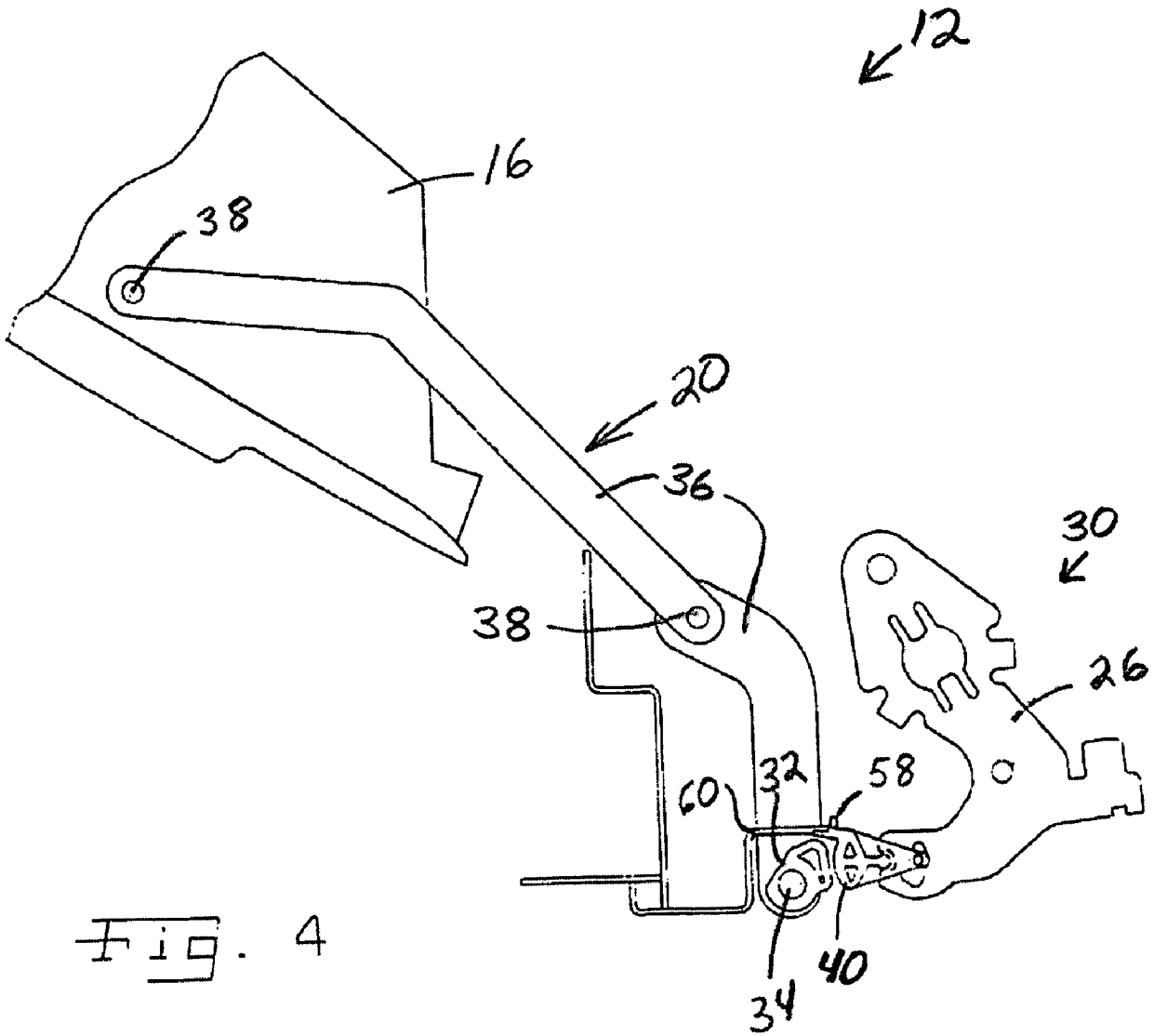
FIG. 4 is a fragmentary, schematic view similar to FIG. 3 but illustrating the cover in an open position and the fuser nip in an unloaded condition.

Referring now to the drawings and particularly to FIG. 1, there is shown an embodiment of a fuser module 10 in accordance with the present invention, suitable for use in an electrophotographic (E.P.) printing apparatus 12 shown in fragmentary form in FIGS. 3 and 4. Apparatus 12 further includes a machine frame 14, a fragment thereof which is schematically represented in FIG. 3. Fuser module 10 is removable from frame 14, as indicated by the dashed line in FIG. 3 interconnecting fuser module 10 and machine frame 14. A cover assembly 16 is pivotally connected to machine frame 14, and can be rotated between closed (FIG. 3) and opened (FIG. 4) positions. A linkage assembly 20 interconnects cover assembly 16 and components of fuser module 10, as will be described in further detail hereinafter. Apparatus 12 further includes other components of a print engine, media feed system and the like (not shown) which are well known to those skilled in the art and will not be described in further detail herein.

Fuser module 10 includes a hot roll 22 in opposed relationship with a pressure roll 24. A path is defined between hot roll 22 and pressure roll 24 through which individual pieces of media pass during printing in printing apparatus 12. A combination of heat and pressure is applied to the media with toner thereon, for fusing and permanently affixing the toner particles to the media. Pressure roll 24 is loaded against hot roll 22 by a loading means such as a bell crank 26 and a spring 28. The manner in which a bell crank and spring are configured to apply pressure from a pressure roll 24 to a hot roll 22 is well known to those skilled in the art and will not be described in further detail herein, except as related to operation of a fuser nip release mechanism 30 in accordance with the present invention.

Fuser nip release mechanism 30 provides an interconnection between cover assembly 16, via linkage assembly 20, and bell crank 26. Fuser nip release mechanism 30 provides an actuating means to engage and disengage the load applied by pressure roll 24 on hot 22. Release mechanism 30 includes a nip release cam 32 rotatable about a cam axis 34. Cam axis 34 is defined by a shaft in base machine frame 14. Linkage assembly 20 includes one or more arms 36 suitably connected by pivots 38 to each other and to cover assembly 16. An end of linkage assembly 20 is connected to shaft 34. Two such arms 36 are shown in FIGS. 3 and 4, connected pivotally to each other, with one arm 36 connected pivotally to cover assembly 16 and the other arm 36 connected to shaft 34 by keyed connection or the like to rotate together. As shown most clearly in FIGS. 3 and 4, movement of cover assembly 16 between a closed (FIG. 3) and an open (FIG. 4) position moves arms 36, causing rotation of shaft 34 and thereby rotation of release cam 32.

Nip release cam 32 is operatively engaged with a nip release cam follower 40 contained in fuser module 10. Cam follower 40 is pivotably connected to bell crank 26 so as to be slightly rotatable relative to bell crank 26. As illustrated in the preferred embodiment shown in the drawings, cam follower 40 includes an extended portion 42 having an enlarged head 44 contained within a slot 46 of bell crank 26. Cam follower 40 includes a follower surface 48 slidable against cam 32 to be moved by the contoured surface of cam 32. Bell crank 26 is moved by movement of cam follower 40, through the connection of head 44 in slot 46. Movement is enacted by rotation of nip release cam 32, with the movement of bell crank 26 being guided also in part by a pin 50 from base 42 disposed within a slot 52 of bell crank 26.

Figure 9:
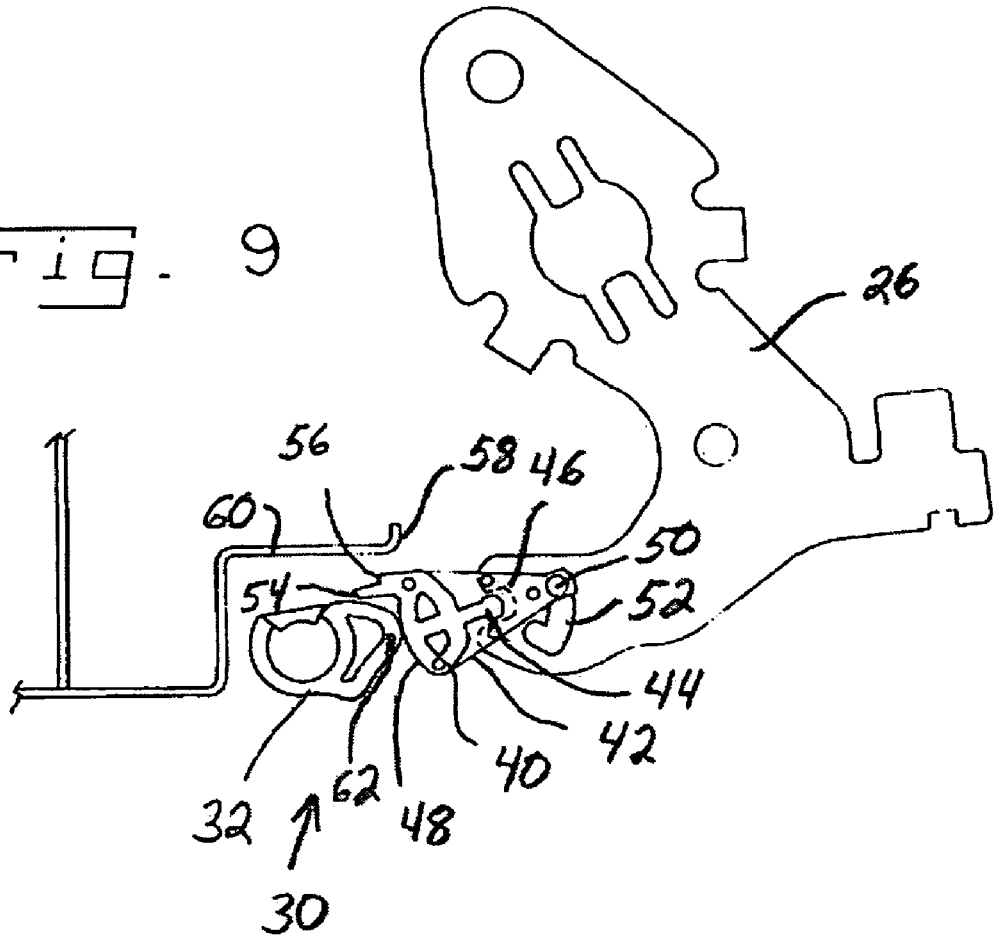
FIG. 9 is a fragmentary, schematic view similar to FIGS. 5–8, but illustrating the release mechanism rotated slightly from the locked and unloaded condition toward the loaded condition.

Operation of nip release mechanism 30 to unload and load the nip formed between pressure roll 24 and hot roll 22 can be best understood by comparing FIGS. 3 and 4 showing the loaded and unloaded conditions, and the sequential views of operation shown in FIGS. 5–9. Cover assembly 16 is a main access cover to the components of printing apparatus 12, and is opened when service or repair is required. With cover assembly 16 in the closed position (FIGS. 3 and 5), pressure roll 24 is loaded against hot roll 22 via bell crank 26 and spring 28. As cover assembly 16 is rotated to the opened position shown in FIG. 4, arms 36 are pulled, thereby rotating shaft 34 and nip release cam 32 in a counter clockwise direction, as shown in the drawings. As nip release cam 32 rotates, cam follower 40 pushes bell crank 26 to move pressure roll 24 away from hot roll 22, thereby opening the nip formed between the two rolls, 22 and 24. Sequential views of nip release mechanism 30 are shown in FIGS. 5–9 as cover assembly 16 is moved from a fully closed position (FIG. 5) to a fully opened position (FIG. 8), and back toward the closed position (FIG. 9).

When cover assembly 16 is rotated back towards the closed position, the resulting clockwise rotation of shaft 34 and cam 32 allows movement of bell crank 26 under the force from spring 28, to again load the nip formed between hot roll 22 and pressure roll 24. Thus, opening cover assembly 16 causes an automatic unloading of the nip formed between hot roll 22 and pressure roll 24, and closing cover assembly 16 causes automatic loading of the nip formed between hot roll 22 and pressure roll 24.

An additional feature of the present invention is that bell crank 26 is secured automatically in a position whereby the nip formed between hot roll 22 and pressure roll 24 is unloaded and the nip opened when cover assembly 16 is moved to a fully opened position. The shape of cam 32 riding against cam follower 40 moves cam follower 40 to provide opening and closing movement of the fuser nip as described above. Friction between cam 32 and cam follower 40 causes tilting of cam follower 40 relative to bell crank 26, performing the locking and unlocking function.

Figure 6:
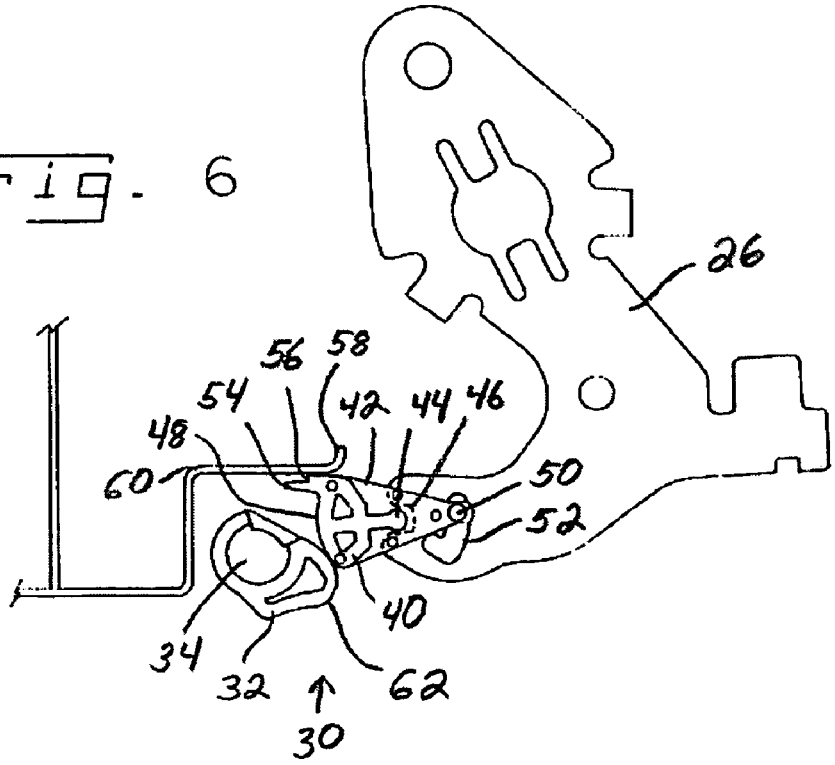
FIG. 6 is a fragmentary, schematic view similar to FIG. 5, but showing the fuser nip release mechanism partly rotated toward the unloaded position.
Figure 7:
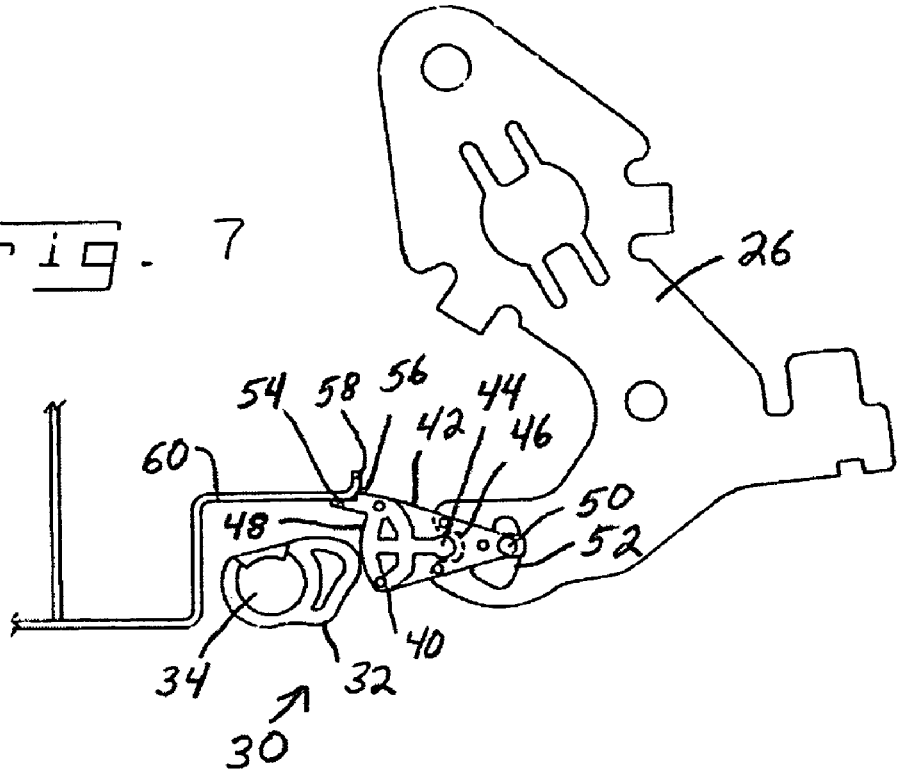
FIG. 7 is a fragmentary, schematic view similar to FIGS. 5 and 6 but, illustrating the release mechanism in a further rotated condition.
Figure 8:
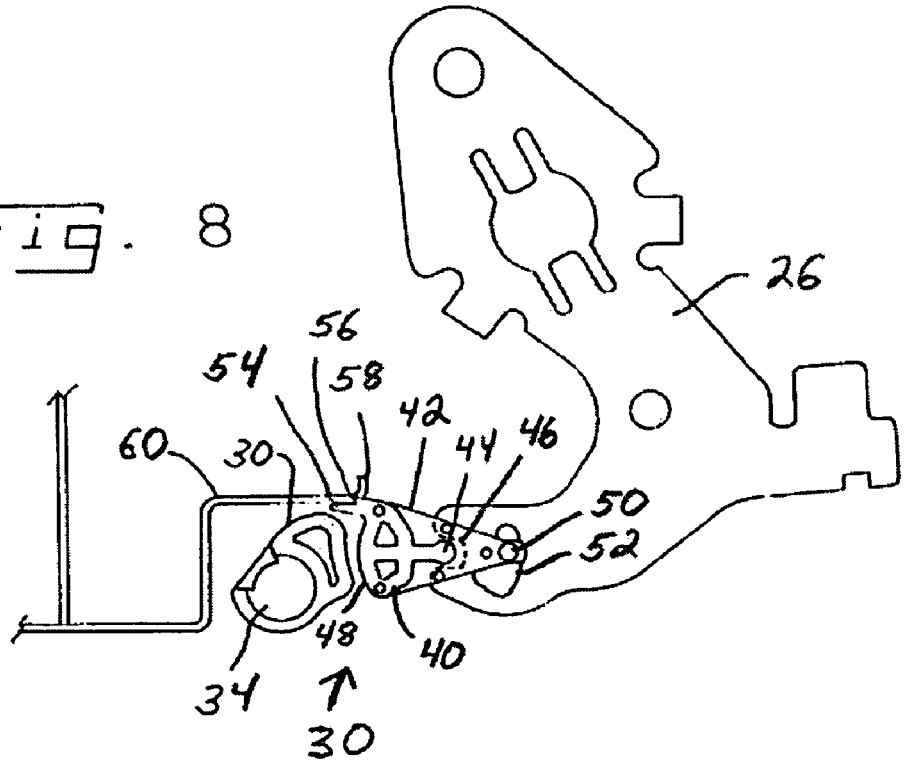
FIG. 8 is a fragmentary, schematic view similar to FIGS. 5–7, but illustrating the release mechanism in a fully unloaded and locked condition.
Figure 10:
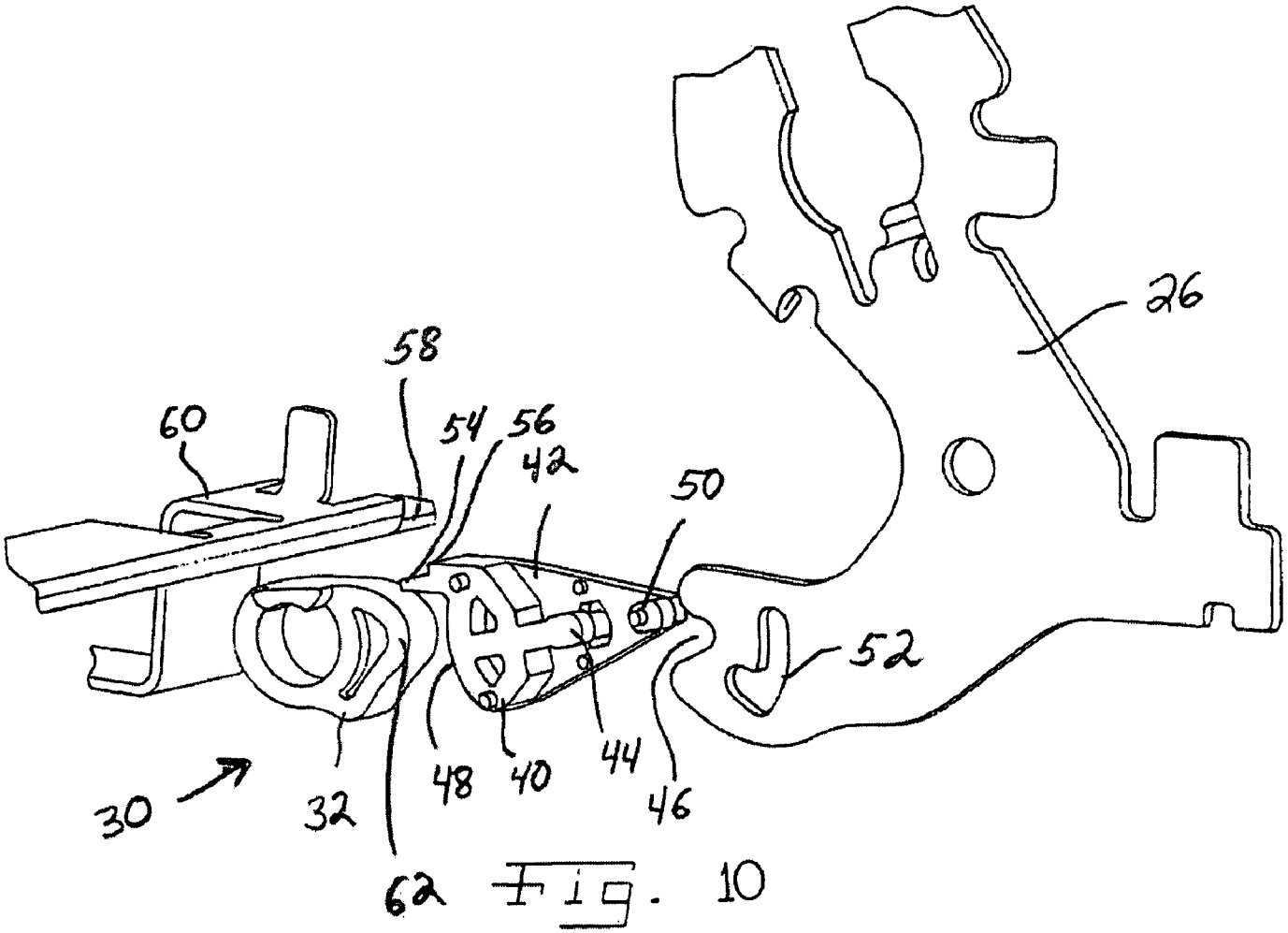
FIG. 10 is a fragmentary, exploded, perspective view of the release mechanism shown in the previous figures.

As most clearly seen in the exploded view of FIG. 10, cam follower 40 includes an arm 54 having a lip or catch 56 that cooperatively associates with a locking feature 58 in the way of an edge on a frame member 60 of fuser module 10. Rotation of cam 32 and the movement of cam follower 40 caused thereby both engages and disengages catch 56 from locking feature 58. As shown in FIG. 6, initial rotation of cam 32 moves arm 54 and catch 56 toward locking feature 58. A most-prominent lobe 62 on cam 32 moves catch 56 past locking feature 58. Friction between cam 32 and cam follower 40, together with the shape of cam 32 when rotated counterclockwise is such as to allow slight angular movement, or tilting, of cam follower 40 relative to bell crank 26, moving arm 54 toward locking feature 58. As cam 32 rotates further counterclockwise, moving lobe 62 away from cam follower 40, bell crank 26 rotates only slightly toward the loading condition. However, catch 56 then engages locking feature 58, securing bell crank 26 in a fixed position, wherein the nip formed between hot roll 22 and pressure roll 24 is open. As nip release cam 32 rotates still further counter clockwise, nip release cam 32 disengages from follower 40 (FIG. 8), and force load from the fuser nip loading mechanism force is no longer transmitted through release mechanism 30 to the base machine. The fuser nip is open and will stay open even if fuser module 10 is removed from machine frame 14, which is facilitated in that the force from spring 28 is carried entirely within fuser module 10.

Figure 5:
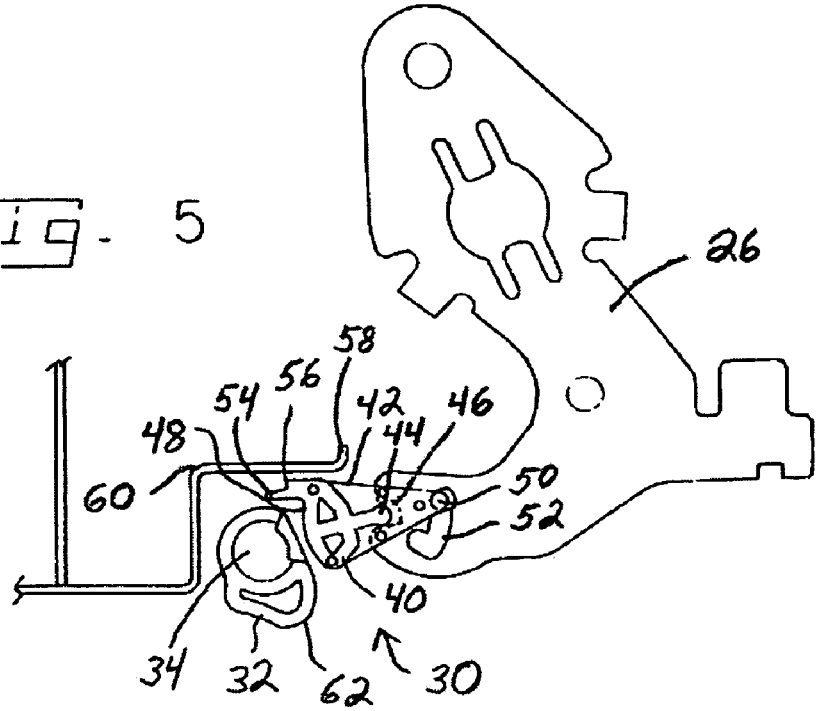
FIG. 5 is a further enlarged, fragmentary, schematic view of the nip release mechanism shown with the fuser nip in a loaded condition.

If cover assembly 16 is moved from the fully open position towards the closed position, nip release cam 32 is thereby rotated clockwise, again pushing bell crank 26 to move pressure roll 24 slightly away from hot roll 22. Movement of cam follower 40 is sufficient to disengage catch 56 from locking feature 58. Friction between cam 32 and cam follower 40 together with the shape of cam 32 causes slight angular movement, or tilting, of cam follower 40 relative to bell crank 26, separating catch 56 from locking feature 58, and allowing catch 56 to slide past locking feature 58. Thereafter, further clockwise rotation of cam 32 caused by movement of cover assembly 16 toward the closed position allows cam follower 40 and bell crank 26 to move pressure roll 24 toward hot roll 22 (FIG. 9), and thereby eventually closing and again loading the nip between hot roll 22 and pressure roll 24 when cover assembly 16 is fully closed (FIGS. 3 and 5).

Actuation of nip release mechanism 30 of the present invention is accomplished by means of opening a machine cover necessary to service or maintain the printing apparatus, with no additional motion or action required from the user. Since cover assembly 16 is relatively large in comparison to the size of fuser module 10, a significant mechanical advantage can be incorporated therein, to reduce the force required from the user to open the cover and unload the fuser nip. Since the nip release is engaged and disengaged by cover movement, there is reduced risk of user error in either installing a fuser with the nip released or accidentally removing the fuser without releasing the nip pressure.

Once the fuser nip is fully opened, it is locked in the open position by features of the fuser module itself. The fuser nip thereby remains open even when the fuser is removed from the machine and totally separated from machine frame 14. Thus, when removed from the machine, hot roll 22 and pressure roll 24 are separated, and the elastomeric compliant covers thereon will not be distorted from a nip relationship between the rolls. With the roll nip open the creation of compression set or other distortions is reduced. As fuser module 10 is installed, the fuser nip is open and no load is transferred between the fuser module and the machine. An individual installing the fuser module does not have to overcome a large load on the fuser due to the nip release mechanism, which makes installation easier. Further, the nip release mechanism is simple in both design and operation, and is relatively inexpensive to supply and assemble, in that it does not require additional gear trains and motors for actuation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A printing apparatus comprising:

a machine frame;

a cover assembly pivotally connected to said machine frame and moveable between closed and opened positions;

a fuser assembly mounted in said machine frame, said fuser assembly and including;

a hot roll;

a pressure roll for forming a fuser nip with said hot roll; and loading means applying force to said pressure roll against said hot roll;

a nip release mechanism operable on said loading means to alternately position said loading means in loading and unloading conditions of said pressure roll against said hot roll; and a linkage assembly interconnecting said cover assembly and said nip release mechanism for operating said nip release mechanism by moving said cover assembly between opened and closed positions.

2. The printing apparatus of claim 1, said fuser assembly including a fuser frame removably mounted in said machine frame.

3. The printing apparatus of claim 2, said nip release mechanism including a cam rotatably mounted in said machine frame and a cam follower rotatably mounted in said fuser frame.

4. The printing apparatus of claim 3, including locking means for securing said pressure roll in an open nip position.

5. The printing apparatus of claim 4, said locking means including an arm on said cam follower engageable with a locking structure on said fuser frame.

6. The printing apparatus of claim 5, said loading means including a bell crank and a spring.

7. The printing apparatus of claim 6, said cam follower being engaged with said bell crank for moving said bell crank by movement of said cam follower.

8. The printing apparatus of claim 7, said cam follower being moveable angularly relative to said bell crank.

9. The printing apparatus of claim 8, said cam follower frictionally engaged by said cam, for angular movement of said cam follower relative to said bell crank upon rotation of said cam.

10. The printing apparatus of claim 8, said bell crank having a slot, and said cam follower having an enlarged head received in said slot of said bell crank.

11. The printing apparatus of claim 1, including locking means for securing said pressure roll in an open nip position.

12. The printing apparatus of claim 11, said locking means including an arm on said cam follower engageable with a locking structure on said fuser frame.

13. A fuser nip release mechanism for a printing apparatus having a machine frame, a cover assembly pivotally connected to the machine frame and a fuser module having a hot roll, a pressure roll nip against the hot roll and loading means including a bell crank for moving said pressure roll with respect to said hot roll, said fuser nip release mechanism comprising:

actuating means to alternately position said loading means in loaded and non-loaded conditions of the pressure roll against the hot roll; and a linkage assembly connecting said actuating means and the cover assembly for moving said actuating means in response to opening and closing the cover assembly.

14. The release mechanism of claim 13, said actuating means including a cam rotated by said linkage means and a cam follower engageable with said cam and connected to said loading means.

15. The release mechanism of claim 14, said cam being rotatably mounted in the machine frame and said cam follower being mounted in said fuser module.

16. The release mechanism of claim 15, including locking means for securing the pressure roll in an open nip position.

17. The release mechanism of claim 16, said locking means being contained in the fuser module, and the fuser module being removable from the machine frame.

18. A nip release mechanism for a printing apparatus having a machine frame, a cover assembly rotatably connected to the machine frame and a removable fuser module including a hot roll, a pressure roll and loading means for holding the pressure roll against the hot roll, said nip release mechanism comprising:

a movable component in the machine frame connected to the cover to be moved by movement of the cover between opened and closed positions;

a follower in the fuser module engageable with said movable component, said follower being moved by movement of said movable component; and a connection between said follower and the loading means for moving the loading means in response to movement of said follower.

19. The nip release mechanism of claim 18, said movable component including a cam rotatably connected to the machine frame.

20. The nip release mechanism of claim 18, including locking structure for securing the pressure roll in an open nip position relative to the hot roll, said locking structure including a first movable component associated with said follower and a second fixed component engageable with said first component, said second component being within the fuser module.

* * * * *